US009283658B2

(12) United States Patent
Marple et al.

(10) Patent No.: US 9,283,658 B2
(45) Date of Patent: Mar. 15, 2016

(54) SELF-CENTERING CLAMP

(71) Applicants: Melvyn James Marple, Douglassville, PA (US); James Arthur Marple, Newtown, CT (US)

(72) Inventors: Melvyn James Marple, Douglassville, PA (US); James Arthur Marple, Newtown, CT (US)

( * ) Notice: Subject to any disclaimer, the term of this patent is extended or adjusted under 35 U.S.C. 154(b) by 72 days.

(21) Appl. No.: 14/242,204

(22) Filed: Apr. 1, 2014

(65) Prior Publication Data

US 2014/0327201 A1 Nov. 6, 2014

Related U.S. Application Data

(60) Provisional application No. 61/817,915, filed on May 1, 2013.

(51) Int. Cl.

| | |
|---|---|
| ***B25B 7/12*** | (2006.01) |
| ***B25B 1/06*** | (2006.01) |
| ***B25B 1/14*** | (2006.01) |
| ***B25B 1/20*** | (2006.01) |
| ***B25B 5/06*** | (2006.01) |
| ***B25B 5/12*** | (2006.01) |
| ***B25B 5/14*** | (2006.01) |

(52) U.S. Cl.

CPC ... *B25B 1/06* (2013.01); *B25B 1/14* (2013.01); *B25B 1/20* (2013.01); *B25B 5/06* (2013.01); *B25B 5/12* (2013.01); *B25B 5/147* (2013.01)

(58) Field of Classification Search

None

See application file for complete search history.

(56) References Cited

U.S. PATENT DOCUMENTS

| | | | | |
|---|---|---|---|---|
| 2,097,402 | A * | 10/1937 | Flarsheim | 269/171 |
| 3,386,726 | A | 6/1968 | Lorenz | |
| 3,637,011 | A * | 1/1972 | Wheeler | 166/77.51 |
| 4,303,270 | A | 12/1981 | Adair | |
| 4,366,606 | A * | 1/1983 | Willis et al. | 269/218 |
| 4,867,835 | A * | 9/1989 | Poole | 156/507 |
| 5,160,151 | A | 11/1992 | Fischer et al. | |
| 5,954,320 | A * | 9/1999 | Bohler | 269/43 |
| 6,412,767 | B1 * | 7/2002 | Beckmann et al. | 269/166 |
| 7,197,963 | B1 * | 4/2007 | Flud | 81/57.19 |
| 2003/0141644 | A1 * | 7/2003 | Thomas | 269/6 |
| 2011/0089620 | A1 * | 4/2011 | Guttenberg | 269/42 |
| 2011/0266409 | A1 * | 11/2011 | Warrick | A61J 1/16 248/316.5 |

* cited by examiner

*Primary Examiner* — Joseph J Hail
*Assistant Examiner* — Brian Keller
(74) *Attorney, Agent, or Firm* — Wendy W. Koba

(57) ABSTRACT

A clamping device is configured to ensure that a workpiece fixed between the jaws of the clamp is self centered by coupling the jaws to a pair of linkages that rotate through the same angle as the application of a first causes the jaws to translate in linear fashion across the surface of the device. In particular, the clamping device utilizes coupled linkage (e.g., a 180° bell crank), in combination with slots for retaining opposing jaws and maintaining only linear movement of the jaws, thus providing a fast and accurate self-centering arrangement. The clamping device may also be located within a hollow workpiece and controlled to move the jaws outward and engage the inner surface of the hollow workpiece in a self-aligned configuration.

6 Claims, 5 Drawing Sheets

SELF-CENTERING CLAMP

CROSS-REFERENCE TO RELATED APPLICATIONS

This application claims the benefit of U.S. Provisional Patent Application Ser. No. 61/817,915, filed May 1, 2013.

TECHNICAL FIELD

The present invention relates to a self-centering clamp and, more particularly to a clamp that utilizes coupled linkage in combination with slots for retaining opposing jaws, thus providing a self-centering clamp arrangement.

BACKGROUND OF THE INVENTION

Stationary clamping devices for milling machines, drill presses and other machines are often required, Rotary clamping configurations for other types of machines (such as a lathe, for example) are another need. In environments such as a machine shop it is often necessary to clamp a workpiece in a manner that is fast, accurate and repeatable—without needing constant adjustments. Indeed, it is often useful to have a clamp that will maintain a workpiece in a "centered" configuration without needing to adjust one clamp and then the other to adjust the position of the workpiece.

However, self-centering clamping devices of the prior art are often inaccurate, lack repeatability, cannot be automated and/or are expensive devices that depend on complicated arrangements, such as gear-based systems or rack-and-pinion types of mechanism, to provide the desired self-centering functionality.

Thus, a need remains in the art for a self-centering clamp that is relatively simple in design, yet can repeatedly and accurately provide properly centered clamping of a workpiece.

SUMMARY OF THE INVENTION

The needs remaining in the prior art are addressed by the present invention, which relates to a self-centering clamp and, more particularly to a clamp that utilizes coupled linkage in combination with slots for retaining opposing jaws, thus providing a self-centering clamp arrangement.

In particular, the present invention comprises a clamp that utilizes coupled linkage (e.g., a 180° bell crank), in combination with slots for retaining opposing jaws and maintaining only linear movement of the jaws, thus providing a fast and accurate self-centering arrangement. It is possible, as will be discussed below, to use arrangements other than slots to confine the jaws to the desired lateral movement in a constrained manner that provides self-centering.

One exemplary embodiment of the present invention comprises a pair of jaws disposed on a support substrate, each jaw positioned within a separate lateral slot formed along a portion of a top surface of the support substrate and disposed such that clamping surfaces face each other and are aligned, an aperture formed through the support substrate in a region between the clamping surfaces of the pair of jaws, an upper linkage coupled between the pair of jaws at a first, upper area of each jaw and a lower linkage coupled between the pair of jaws at a second; lower area of each jaw. The application of a lateral force to either one or both of the jaws causes the upper and lower linkages to rotate through a same angle and provide a like movement of each jaw, providing a self-centering clamping action to a workpiece disposed in the aperture between the clamping surfaces of the jaws.

In another embodiment, a configuration of the clamping device can be arranged with the jaws facing outward, with a hollow workpiece disposed over the clamping device such that the outward-facing jaws engage the interior of the workpiece is a self-aligned arrangement.

Other and further embodiments and arrangements of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
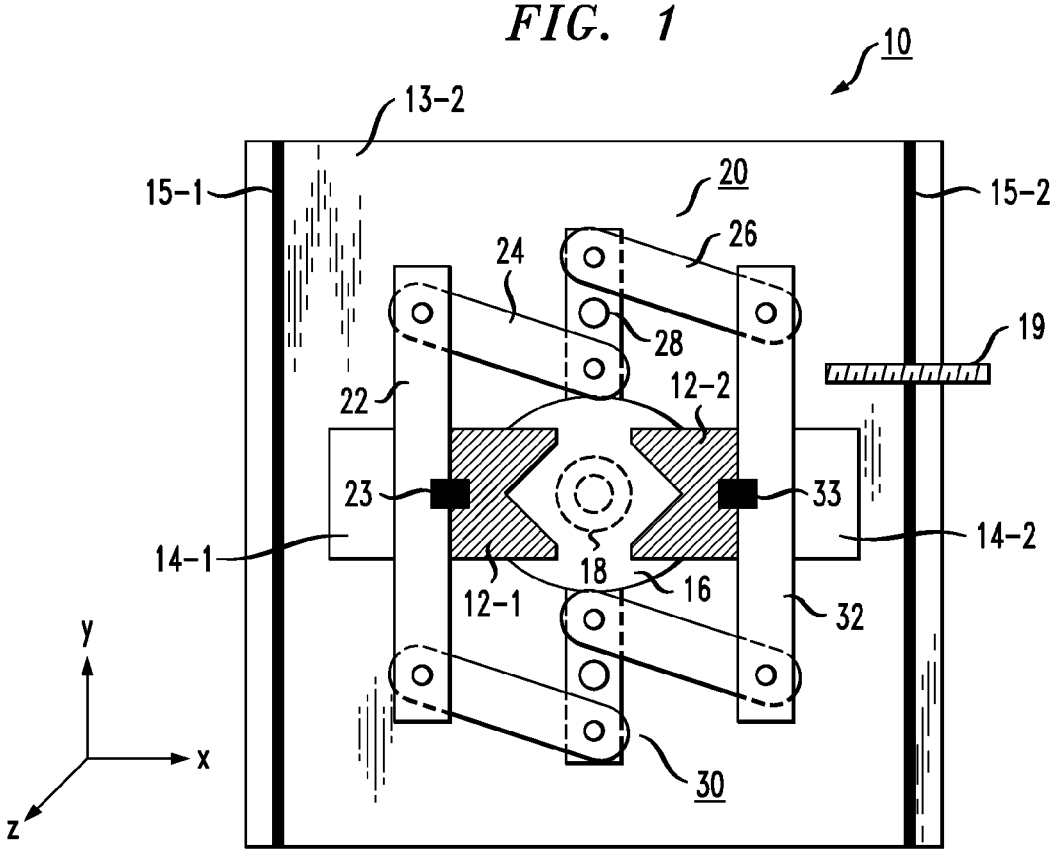
FIG. 1 is a front view of a self-centering clamping device formed in accordance with the present invention.

FIG. 1 is a front view of an exemplary self-centering clamp 10 formed in accordance with the present invention. As shown, self-centering clamp 10 comprises a pair of jaws 12-1, 12-2 that are disposed to ride back and forth within slots 14-1 and 14-2, respectively. In the orientation of FIG. 1, jaws 12 are constrained to translate only in the x-axis direction (i.e., only linear movement), moving back and forth within slots 14. The use of slots should only be considered as exemplary only. Any other arrangement that provides confinement of the jaws to maintain one-dimensional, lateral motion may be used. For example, a pair of enclosures (such as C-channels) for enclosing jaws 12 may be used. Moreover, the jaws themselves may have any suitable geometry, the V-shaped end faces shown in the drawings is considered to be exemplary only.

Figure 2:
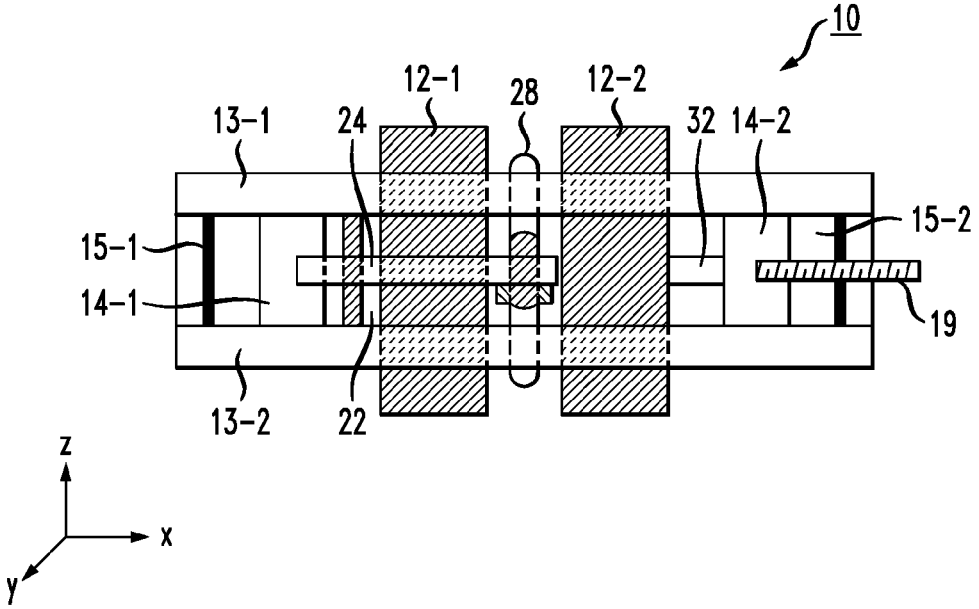
FIG. 2 is a top view of the embodiment as shown in FIG. 2.

Further, and as best shown in the top view of FIG. 2, movement of jaws 12 out of the plane of device 10 (i.e., into the z-direction) is constrained by disposing jaws 12 (as well as the linkage that is attached to jaws 12 and controls their movement) between a pair of coverplates 13-1 and 13-2. In FIG. 1, coverplate 13-1 has been removed to allow for the working components of the clamping device to be clearly visible. In the top view of FIG. 2, both coverplate 13-1 and coverplate 13-2 are clearly shown, and in particular illustrate their use in constraining movement of jaws 12 in the z-direction. It is to be noted that for the sake of clarity, the view of FIG. 2 illustrates the details of the connections between the various components on the left-hand side only.

Also shown in both FIGS. 1 and 2 is a pair of separator bars 15-1 and 15-2 that are used to define the fixed space of confinement between coverplates 13-1 and 13-2 where the device components are located. An adjustable stop 19, as will be described below, is also shown in FIGS. 1 and 2.

A central through-hole aperture 16 is shown in FIG. 1 as being formed through the thickness of coverplate 13-2 (as well as through coverplate 13-1 when in place), with an exemplary pipe 18 shown in phantom as positioned within aperture 16. In accordance with the present invention, clamping device 10 functions to hold pipe 18 in a self-centered configuration (with respect to the boundaries of device 10), allowing for various machining operations (e.g., cutting, turning, etc.) to be performed on a "centered" pipe without worrying about the need to perform any additional adjustments (such as movement of one clamp, and then the other, to center the pipe within the fixture). While a rounded pipe is shown in FIG. 1, other cross-sections are possible (e.g., square, hexagonal, etc.).

An upper linkage 20 is shown in FIG. 1 as coupled between jaw 12-1 and jaw 12-2. Similarly, a lower linkage 30 is shown as coupled between jaw 12-1 and jaw 12-2. A first upright member 22 is shown as attached to jaw 12-1 (at location 23, for example) and disposed between the left-hand terminations of linkages 20 and 30. A second upright member 32 is similarly attached to jaw 12-2 (at location 33, for example) and disposed between the right-hand terminations of linkages 20 and 30.

As will be described in detail below, by virtue of joining the movement of the jaws together, and constraining their movement to be one-dimensional, it is possible to create an arrangement where each jaw moves the same distance upon the application of force (to either jaw, or both jaws), forming a self-centered system. That is, the application of a force along the x-axis of self-centering clamping device 10 causes linkages 20 and 30 to rotate in a manner where jaws 12-1 and 12-2 will simultaneously move either toward each other (inward) or away from each other (outward). In either case, jaws 12-1 and 12-2 will translate the same distance d along their respective slots 14-1 and 14-2 so as to maintain the centrality of the opening therebetween.

Figure 3:
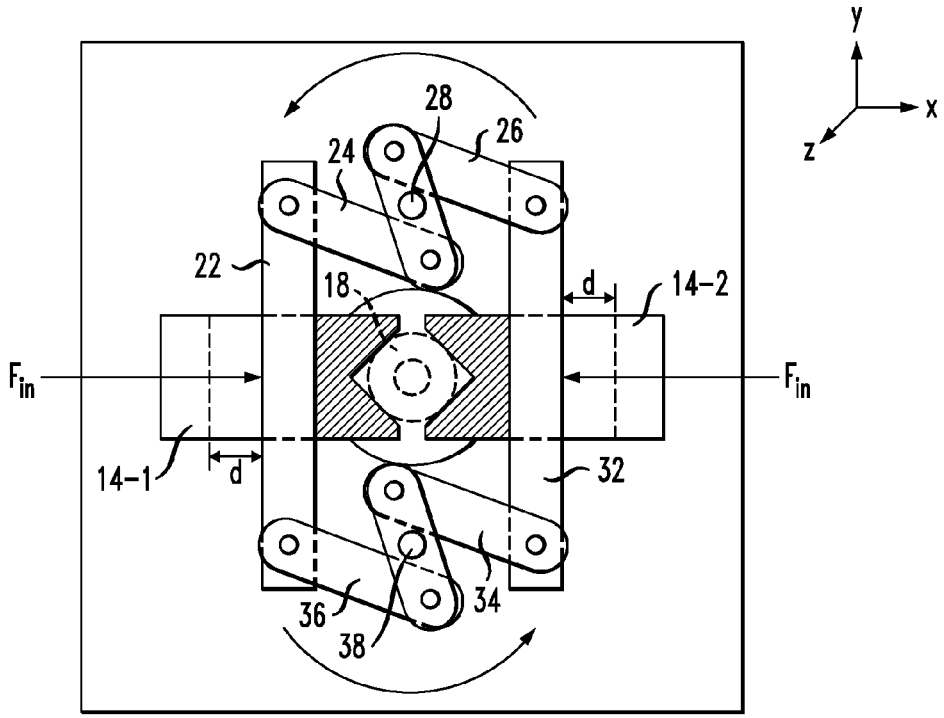
FIG. 3 is another front view of the inventive clamping device, in this case illustrating the application of a force $F_{in}$ that provides for an inward movement of each jaw along the same lateral direction, allowing for any workpiece disposed between the clamping jaws to be held is a self-centered orientation with respect to the outer periphery of the clamping device.

FIG. 3 is a front view of self-centering clamping device 10 that illustrates the rotation of linkages 20 and 30 when an "inward" force $F_{in}$ is applied to a pair of side uprights 22 and 32 joining linkages 20 and 30. Upright 22 is connected to jaw 12-1 and upright 32 is connected to jaw 12-2. The application of this force is translated through rocker arms 24, 26 (of linkage 20) and rocker arms 34, 36 (of linkage 30), providing a rotating motion to shafts 28 and 38 (e.g., 180° bell cranks). In this configuration, shafts 28 and 38 are rotating counterclockwise. By virtue of the connection between linkages 20 and 30 (via uprights 22 and 32), jaws 12-1 and 12-2 will translate the same distance inward d along each of their respective slots 14-1 and 14-2 (where this movement is constrained to remain one-dimensional, translating only in the x-direction). Therefore, centering is maintained and, in this view, pipe 18 is clamped between jaws 12-1 and 12-2 in a self-centered arrangement with respect to clamping device 10.

The force itself may be provided in numerous ways including, but not limited to, air cylinders, levers, hydraulic cylinders, ball screws, electric solenoids or, as an alternative, providing a force directly to the linkage itself. Indeed, arrangements for applying a force to one or both of the jaws may use a combination of elements, such as a turning shaft (such as a crank or other rotational element) connected to a separate element for converting rotational motion into the translational motion used for jaws 12.

While the embodiment as shown in FIG. 3 provides a force $F_{in}$ at each side upright 22 and 32, it is to be understood that only a single force is required to initiate the self-centering motion. The use of only a single force (such as, for example, applied to side upright 22 only) may be advantageous in situations where the ability to access both uprights is limited.

Figure 4:
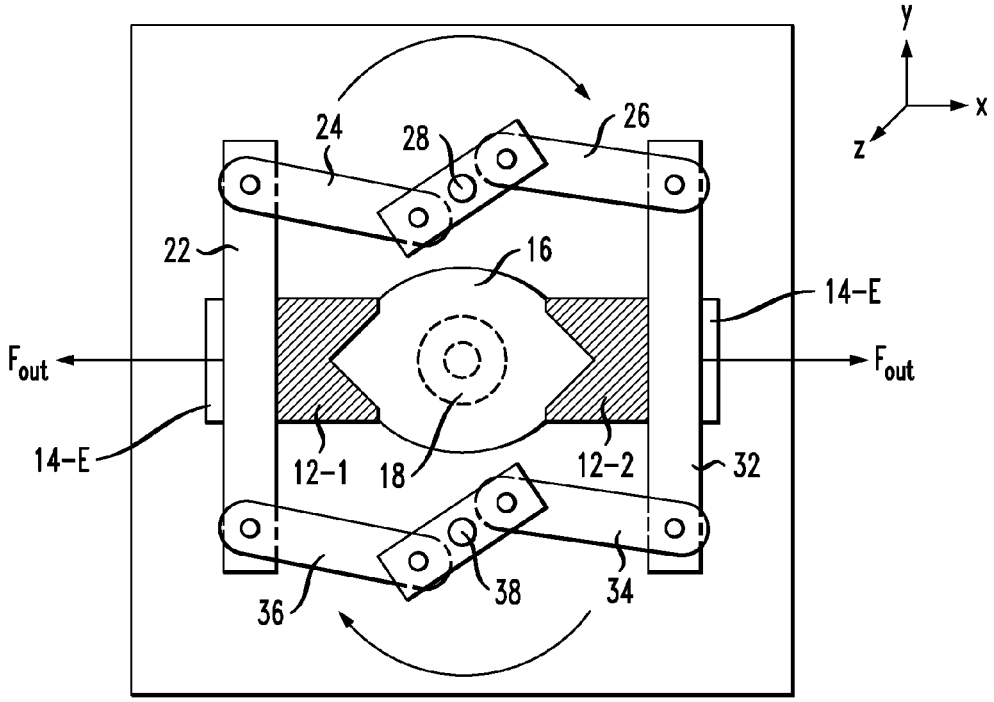
FIG. 4 is yet another front view of the self-centering clamping device of the present invention, in this case illustrating the application of a force $F_{out}$ that provides for a like outward movement of each jaw.

FIG. 4 is another front view of self-centering clamping device 10, in this case illustrating the movement of jaws 12 in the opposite direction (i.e., outward along the x-axis direction). That is, a force $F_{out}$ is applied to side uprights 22 and 32, moving jaws 12-1 and 12-2 outward along their respective slots 14-1 and 14-2, revealing a larger opening in the area of aperture 16 so as to allow for a larger workpiece to be retained within the inventive clamping device. Obviously, once the larger workpiece is inserted in place, a force $F_{in}$ is applied to hold the larger workpiece in a self-centered configuration. It is to be noted that the end walls 14-E of slots 14-1 and 14-2 function as "stops", preventing any further movement of jaws 12-1 and 12-2.

The specific length of slots 14 is considered to be a design choice, defining the greatest opening that can be created between jaws 12-1 and 12-2. Indeed, as particularly illustrated in FIGS. 1 and 2, it is possible to include an adjustable stop member 19 (in this case an adjustable screw) that controls the range of motion of uprights 22 and 32, thus controlling the dimensions of the opening created between jaws 12-1 and 12-2.

Figure 5:
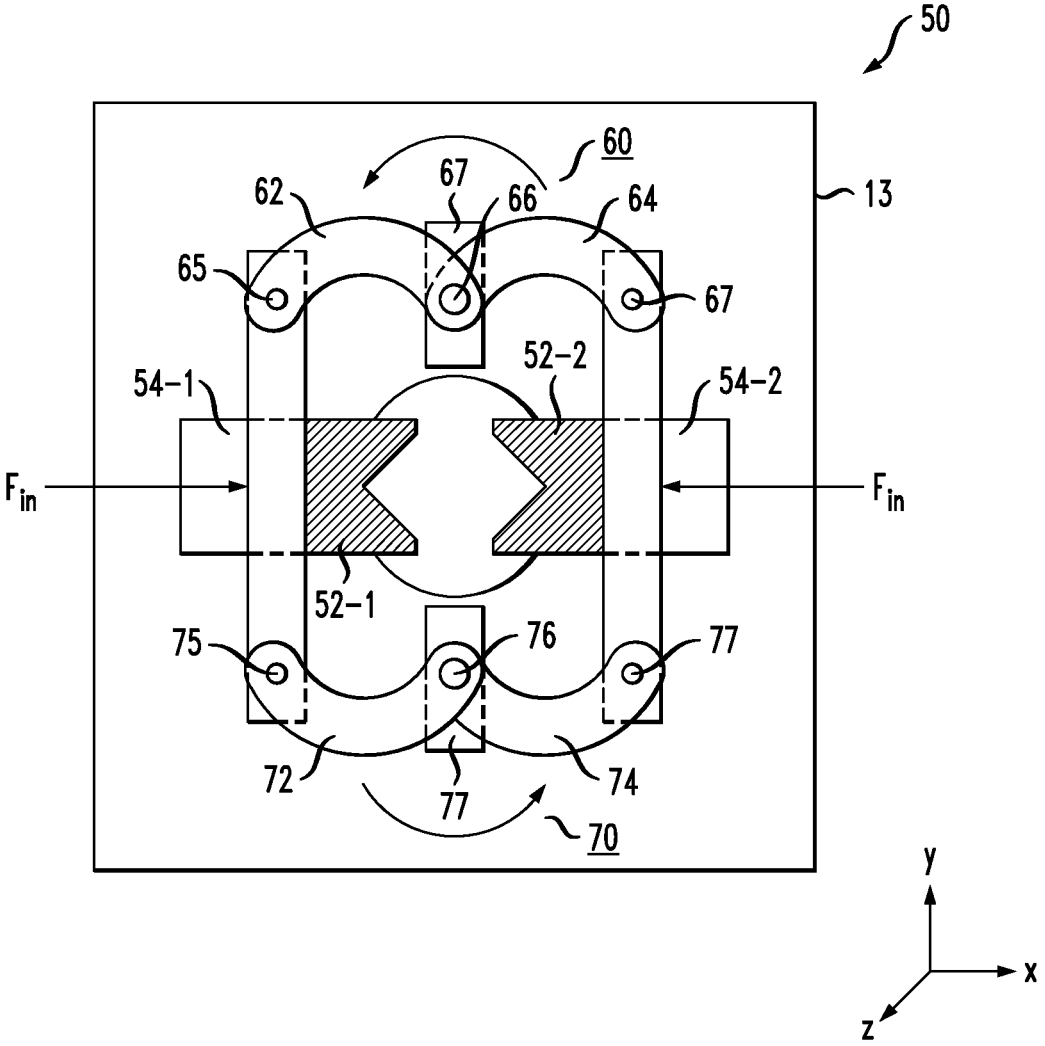
FIG. 5 is a front view of an alternative embodiment of the present invention, in this case using a different type of linkage to couple the jaws together and provide the uniform movement thereof.

While one specific embodiment has been described thus far, it is to be understood that the self-centering clamp of the present invention may utilize various arrangements and dimensions of the slots, jaws and linkages. Indeed, FIG. 5 illustrates an alternative embodiment of the present invention, in this case showing a self-centering clamping device 50 with a different type of linkage formed in accordance with the present invention.

As with clamping device 10, clamping device 50 comprises a pair of jaws 52-1 and 52-2, where each jaw is constrained to travel only in the x direction within its associated slots 54-1 and 54-2, respectively, formed in substrate block 53. A first side upright 56 is attached across jaw 52-1 (in the y-axis direction), with a second side upright 58 attached in a similar across jaw 52-2, such that uprights 56 and 58 are parallel.

In accordance with this embodiment of the present invention, an upper linkage 60 is coupled between top end terminations of first side upright 56 and second side upright 58. A lower linkage 70 is similarly coupled between lower end terminations of first side upright 56 and second side upright 58. As with the embodiment described above, the application of a force F to one or both of side uprights 56 and 58 functions to cause linkages 60 and 70 to rotate in a manner such that jaws 52-1 and 52-2 will open (or close) by a prescribed distance d, providing a self-centering clamping to any workpiece disposed within aperture 80 between jaws 52-1 and 52-2.

In this embodiment, upper linkage 60 comprises a pair of scissor-like arms 62 and 64, coupled together at a pin location 66. Arms 62 and 64 remain free to rotate with respect to one another when a force is applied to one of the side uprights, where pin 66 travels (in the y-direction) within an associated slot 67. The opposite termination of first arm 62 is attached via a pin 65 to an upper portion of first side upright 56. The opposite termination of second arm 64 is attached via a pin 67 to an upper portion of second side upright 56.

Lower linkage 70 includes a like pair of coupled arms 72 and 74 (coupled together at pin 76 which travels within slot 77). The opposing ends of arms 72 and 74 are also connected to side uprights 56 and 58 (via pins 75 and 77, respectively).

As with the embodiment described above, the application of a force F to one or both of the uprights causes the arms forming linkages 60 and 70 to rotate with respect to each other, resulting in the simultaneous movement of jaws 52-1 and 52-2 to provide self-centered clamping.

Figure 6:
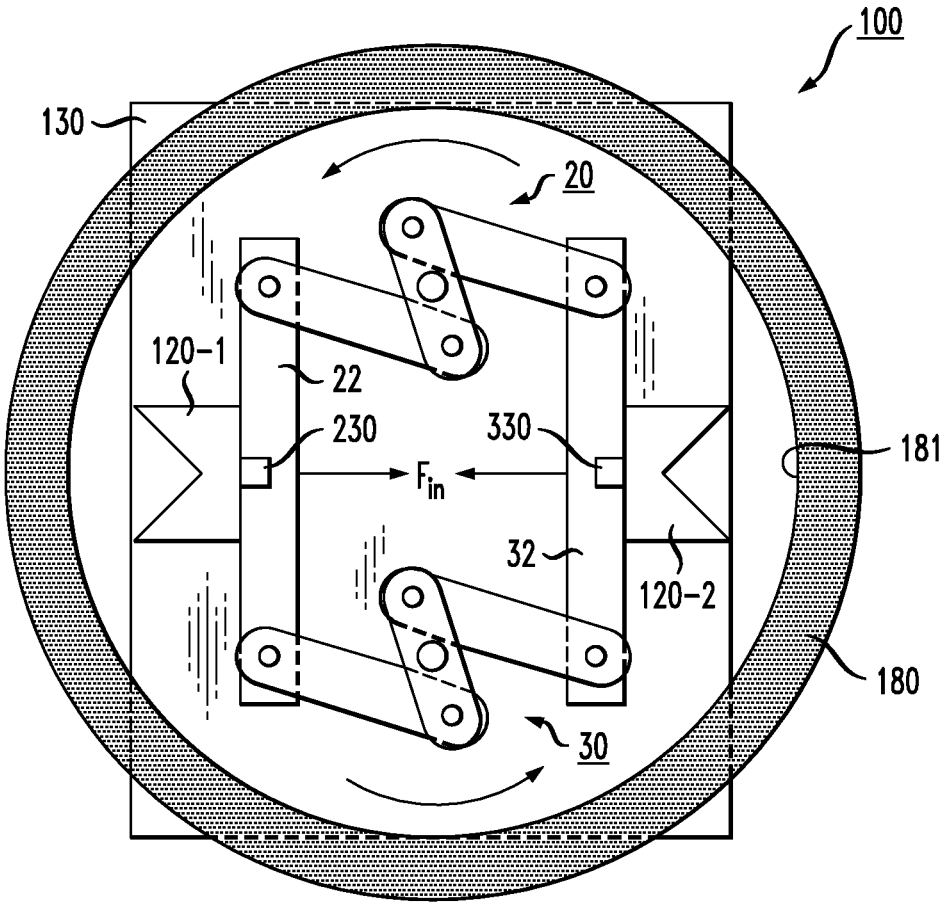
FIG. 6 is a front view of yet another embodiment of the present invention, in this case using the self-centering clamping device to hold the inner surface of a pipe in a self-centered configuration.
Figure 7:
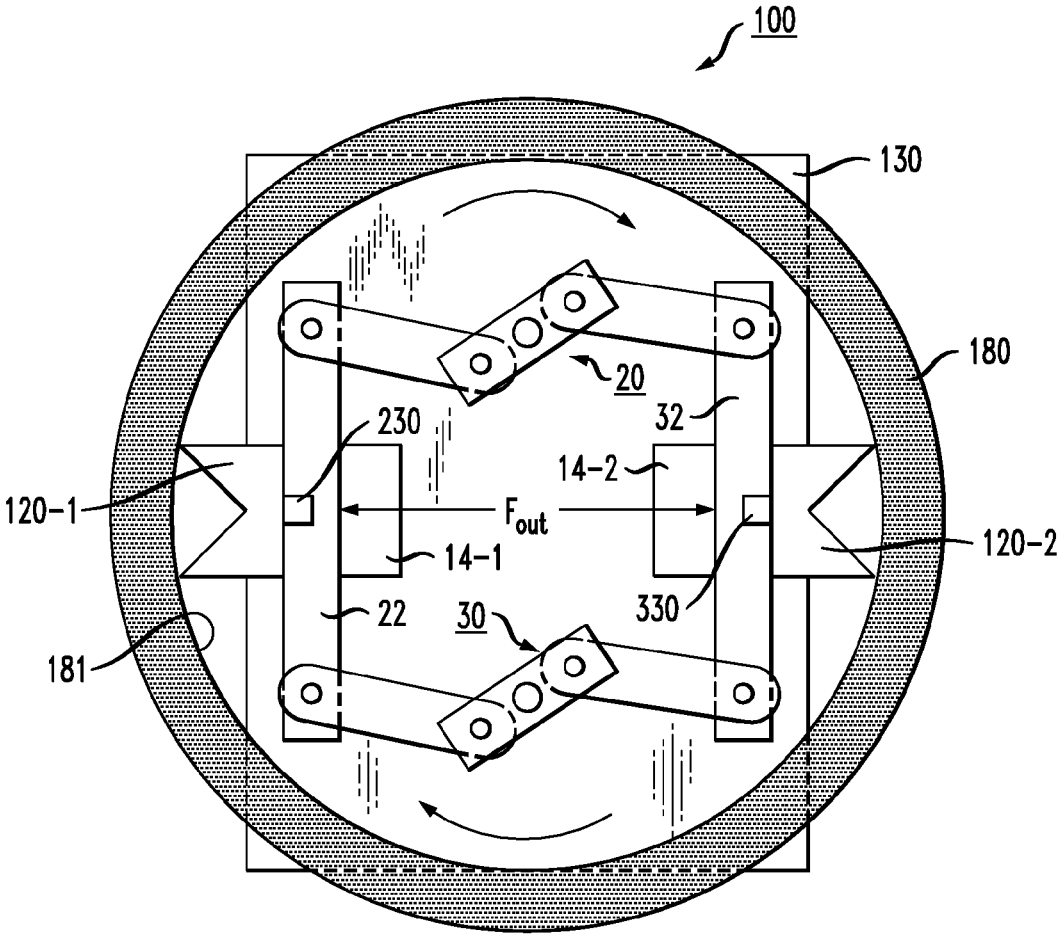
FIG. 7 shows the same embodiment as that of FIG. 6, in this case with the jaws of the clamping device engaging the inner surface of a pipe.

As mentioned above, it is also possible to use the self-centering clamping device of the present invention as an arrangement that is disposed within a hollow tube (pipe), clamping the inner surface of the pipe and holding the pipe in a self-centered position with respect to the clamping device. FIGS. 6 and 7 are front views of an embodiment of the present invention that is suitable for this inner clamping configuration.

FIG. 6, in particular, is a front view of an exemplary self-centering clamping device 100. In order to understanding the operation of the clamping device, a cover plate has been removed (similar to the embodiment as shown in FIG. 1). In comparing the particular elements of clamping device 100 to those forming clamping device 10 of FIG. 1, it is shown that linkages 20 and 30 may be the same, with the same pair of uprights 22 and 32 connecting together upper linkage 20 with lower linkage 30. In contrast to device 10, the inner clamping arrangement of device 100 includes a pair of jaws 120-1 and 120-2, with jaw 120-1 shown as attached to an outer edge of upright 22 at location 230. Jaw 120-2 is shown as attached to an outer edge of upright 32 at location 330.

In the view of FIG. 6, a hollow pipe 180 is shown as disposed to surround clamping device 100, with an inward-directed force $F_{in}$ bringing jaws 120-1 and 120-2 close to the center of device 100. In operation, an outward force $F_{out}$ is applied to jaws 120-1 and 120-2, which will then move simultaneously (and only along the x-axis direction, as noted above) and engage inner wall 181 of pipe 180.

FIG. 7 shows clamping device 100 in the configuration of holding pipe 180 in a self-centered displacement with respect to device 100. In particular, it is shown that linkages 20 and 30 have rotated (via the application of the force $F_{out}$ to uprights 22 and 32, moving jaws 120-1 and 120-2 outward until they (simultaneously) engage inner wall 181 of pipe 180. Portions of slots 14-1 and 14-2 are evident in this view.

It is to be understood that the various embodiments of the self-centering clamp of the present invention may be formed of any material suitable for its intended use. For example, a self-centering clamp of the present invention may be used in many non-industrial applications (e.g., centering a flagpole (or similar banner) in a stand, a Christmas tree, or the like). In non-industrial environments a plastic or polymer-based device may be used. In industrial applications, a metal device is preferred (e.g., machine-hardened steel, aluminum, or the like). All of these variations are considered to fall within the spirit and scope of the present invention.

What is claimed is:

1. A self-centering clamping device comprising:

a pair of jaws disposed on a first coverplate, each jaw positioned within a separate lateral slot formed along a portion of a top, surface of the first coverplate, the jaws disposed such that clamping surfaces are aligned;

a first upright attached to a first jaw of the pair of jaws and extending in a direction perpendicular to the associated lateral slot and in the plane of the first coverplate:

a second upright attached to a second jaw of the pair of jaws and extending in the direction perpendicular to the associated lateral slot and in the plane of the first coverplate;

an upper linkage coupled between upper end terminations of the first and second uprights;

a lower linkage coupled between lower end terminations of the first and second uprights and a second coverplate disposed over, the pair of jaws, the first and second uprights and the upper and lower linkages in a manner parallel with the first coverplate, with an aperture formed through the first and second coverplates in a central area between the clamping surfaces of the pair of jaws, wherein the application of a lateral force to either one or both of the jaws causes the upper and lower linkages to rotate through a same angle and provide a like movement of each jaw, providing a repeatable, precision self-centering clamping action to a workpiece disposed within the aperture.

2. A self-centering clamping device as defined in claim 1 wherein the self-centering clamping device is configured to be disposed within a hollow workpiece with the pair of jaws disposed to engage an inner surface of the hollow workpiece.

3. A self-centering clamping device as defined in claim 2 wherein the pair of jaws is attached to outer edge surfaces of a pair of uprights disposed between the upper linkage and the lower linkage.

4. A self-centering clamping device as defined in claim 1 wherein each lateral slot includes an end stop termination to prevent the associated jaw from moving beyond a boundary of the first coverplate.

5. A self-centering clamping device as defined in claim 1 wherein the upper linkage further comprises a pair of upper rocker arms, a first upper rocker arm pivotally attached to the first jaw and a second upper rocker arm pivotally attached to the second jaw; and an upper shaft pivotally coupled between the first and second upper rocker arms; and the lower linkage further comprises a pair of lower rocker arms, a first lower rocker arm pivotally attached to the first jaw and a second lower rocker arm pivotally attached to the second jaw; and a lower shaft pivotally coupled between the first and second lower rocker arms, wherein upon application of a force to one or both of the jaws, the upper and lower rocker arms cause the upper and lower shafts to rotate a like amount, moving the jaws the same distance, as a function of the applied force.

6. A self-centering clamping device as defined in claim 1 wherein the upper linkage comprises a pair of scissor-like upper curved arms coupled together at a central pivot point, with an opposite end of a first upper curved arm pivotally attached to the first jaw and an opposite end of a second upper curved arm pivotally attached to the second jaw, and the lower linking comprises a pair of scissor-like lower curved arms coupled together at a central pivot point, with an opposite end of a first lower curved arm pivotally attached to the first jaw and an opposite end of a second lower curved arm pivotally attached to the second jaw.

* * * * *